United States Patent [19]

Clearman et al.

[11] Patent Number: 4,917,128

[45] Date of Patent: Apr. 17, 1990

[54] CIGARETTE

[75] Inventors: Jack F. Clearman, Blakely, Ga.; Thomas L. Gentry, Winston-Salem; Gary R. Shelar, Greensboro, both of N.C.

[73] Assignee: R. J. Reynolds Tobacco Co., Winston-Salem, N.C.

[21] Appl. No.: 136,261

[22] Filed: Dec. 22, 1987

Related U.S. Application Data

[63] Continuation-in-part of Ser. No. 791,721, Oct. 28, 1985, Pat. No. 4,756,318.

[51] Int. Cl.[4] ..... A24D 1/18; A24D 1/00; A24D 1/02

[52] U.S. Cl. ..... 131/359; 131/194; 131/273; 131/360

[58] Field of Search ..... 131/194, 195, 196, 359, 131/360, 347, 273

[56] References Cited

U.S. PATENT DOCUMENTS

| | | |
|---|---|---|
| Re. 27,214 | 11/1971 | Nakahara . |
| 1,529,181 | 3/1925 | Holmes . |
| 2,178,820 | 11/1939 | Todoroff . |
| 2,907,686 | 10/1959 | Siegel . |
| 2,976,190 | 3/1961 | Meyer . |
| 3,106,210 | 10/1963 | Reynolds . |
| 3,258,015 | 6/1966 | Ellis . |
| 3,356,094 | 12/1967 | Ellis . |
| 3,516,417 | 6/1970 | Moses . |
| 3,586,005 | 6/1971 | Lippman . |
| 3,614,956 | 10/1971 | Thornton . |
| 3,738,374 | 6/1973 | Bennett . |
| 3,943,941 | 3/1976 | Boyd et al. . |
| 4,044,777 | 8/1977 | Boyd et al. . |
| 4,044,778 | 8/1977 | Cohn . |
| 4,079,742 | 3/1978 | Ranier et al. . |
| 4,219,031 | 8/1980 | Ranier et al. . |
| 4,284,089 | 8/1981 | Ray . |
| 4,286,604 | 9/1981 | Ehretsman et al. . |
| 4,291,711 | 9/1981 | Berger . |
| 4,326,544 | 4/1982 | Hardwick et al. . |
| 4,340,072 | 7/1982 | Bolt et al. . |
| 4,347,855 | 9/1982 | Lanzillotti et al. . |
| 4,391,285 | 7/1983 | Burnett et al. . |
| 4,407,308 | 10/1983 | Baker . |
| 4,474,191 | 10/1984 | Steiner . |
| 4,756,318 | 7/1988 | Clearman et al. ..... 131/359 |

FOREIGN PATENT DOCUMENTS

| | | |
|---|---|---|
| 276250 | 8/1983 | Australia . |
| 117355 | 8/1984 | European Pat. Off. . |
| 1294351 | 5/1964 | Fed. Rep. of Germany . |
| 370692 | 10/1906 | France . |
| 998556 | 1/1952 | France . |
| 1264962 | 5/1961 | France . |
| 2033749 | 11/1970 | France . |
| 2057421 | 4/1971 | France . |
| 2057422 | 4/1971 | France . |
| 45-9894 | 5/1960 | Japan . |
| 68-8684/k967 | 6/1968 | Japan . |
| 13985/3890 | 9/1985 | Liberia . |
| 1185887 | 3/1970 | United Kingdom . |
| 1431045 | 4/1972 | United Kingdom . |

OTHER PUBLICATIONS

Certain Materials Submitted to the Senate Committee on Commerce by Mr. Herbert A. Gilbert in Sep. of 1967.

A copy of the newspaper article which was reproduced in the AAR Materials.

Tobacco Substitutes, Noyes Data Corporation, (1976).

Guinness World Book of Records, pp. 242–243 (1985 Edition).

Guinness World Book of Records, p. 194 (1966 Edition).

*Primary Examiner*—V. Millin

*Assistant Examiner*—J. Welsh

*Attorney, Agent, or Firm*—Grover M. Myers; David G. Conlin

[57] ABSTRACT

Embodiments of the present cigarette comprise a roll or rod of tobacco wrapped by a paper wrapper, a short conbustible carbonaceous fuel element encircled by a resilient insulating member, a physically separate smoke generator including smoke forming substance located within a heat conductive container, the tobacco forming a jacket around the container and the smoke generator, and a relatively long mouthend piece.

These cigarettes provide the smoker with the taste, satisfaction, feel and aroma of a cigarette without burning tobacco. Preferred cigarettes are capable of producing substantial quantities of smoke, both initially and over the useful life of the product, without thermal degradation of the smoke former and without the presence of substantial pyrolysis or incomplete combustion products or sidestream smoke.

7 Claims, 1 Drawing Sheet

CIGARETTE

CROSS-REFERENCE TO RELATED APPLICATION

This application is a continuation-in-part of U.S. Ser. No. 06/791,721, filed 28 Oct. 1985, now U.S. Pat. No. 4,756,318.

BACKGROUND OF THE INVENTION

The present invention relates to cigarettes which produce smoke which contains no more than a minimal amount of incomplete combustion or pyrolysis products.

In recent years, the taste in cigarette products in certain areas of the world has been changing toward lighter and lighter cigarettes, i.e., cigarettes which produce less "tar" when smoked. "Tar" in such cigarettes has consisted in large part of tobacco pyrolysis or decomposition products. Prior to the present invention, it has generally been considered necessary to deliver such tobacco pyrolysis products to the smoker, in order for the smoker to enjoy the taste and satisfaction of cigarette smoke.

In order to produce the "lighter" smoke called for by smokers in recent years, a variety of technical changes have been made to cigarettes. Filtration has been employed to reduce the delivery of "tar" or certain components thereof, e.g., to screen out certain components which affect the flavor or quality of the smoke. Air dilution has been employed to dilute and "lighten" the smoke. Reconstituted and expanded tobaccos have been used, and flavorants have been added to the tobacco, to the filters, or elsewhere, in order to enhance the flavor of the "light" smoke thus produced.

SUMMARY OF THE INVENTION

The present invention relates to cigarettes which are capable of producing substantial quantities of smoke, both initially and over their useful life, preferably without thermal degradation of the tobacco, and without the presence of pyrolysis or incomplete combustion products.

The cigarettes of the present invention comprise a roll or rod of cut tobacco cylindrically wrapped in a paper wrapper. A heat conductive container is preferably located in a longitudinal passage in the tobacco roll. A smoke generating means, including a smoke forming material is located within the container. The cigarette also is preferably provided with a short, i.e., less than about 30 mm long, preferably carbonaceous, fuel element located at one end of the container. A resilient insulating member at least 0.5 mm thick preferably circumscribes the periphery of the fuel element. The roll or jacket of tobacco encircles at least a portion of the smoke generating means, and is arranged so that gases and/or the smoke forming substance pass through the tobacco during smoking, to contribute volatile tobacco flavors to the smoke.

The placement of a tobacco roll or rod around the periphery of the smoke generating means in close proximity to the fuel element helps to maximize heat transfer to the tobacco and the release of volatile tobacco flavors from the tobacco. This peripheral tobacco jacket also provide the smoker with the taste, satisfaction, aroma and feel of a cigarette.

Preferred cigarettes of the type described herein are particularly advantageous because the hot, burning fire cone is always close to the smoke generating means and the non-burning tobacco rod, which maximizes heat transfer thereto and maximizes the resultant production of smoke and tobacco flavor, especially in embodiments which are provided with a multiple passageway fuel element, a heat conducting member, and/or an insulating member. In addition, because the smoke forming substance is physically separate from the fuel element, it is exposed to substantially lower temperatures than are present in the burning fire cone, thereby minimizing the possibility of thermal degradation of the smoke former.

The cigarette of the present invention is preferably provided with a mouthend piece including an additional flavor enhancer made from a tobacco sheet material, as well as a low efficiency filter. Preferably, the mouthend piece components are resilient. Advantageously, the cigarettes of the present invention have the same overall dimensions as current cigarettes, and the mouthend piece usually extends over about one-half or more of the length of the cigarette. Alternatively, the mouthend piece or smoke delivery means, can be a separate, preferably reusable device, e.g. a cigarette holder.

In some embodiments of the cigarettes of the present invention, the smoke generating means includes an additional charge of tobacco to add additional tobacco flavors to the smoke. Advantageously, this additional tobacco charge may be placed at the mouthend of the smoke generating means, or it may be mixed with a carrier for the smoke forming substance. Other substances, such as tobacco extracts or other flavoring agents, may be incorporated in a similar manner. Additionally, in some embodiments, a tobacco charge is used as the carrier for the smoke forming substance.

Preferred embodiments of this invention are capable of delivering at least 0.6 mg of smoke, measured as wet total particulate matter (WTPM), in the first 3 puffs, when smoked under FTC smoking conditions, which consist of a 35 ml puff volume of two seconds duration, separated by 58 seconds of smolder. More preferably, embodiments of the invention are capable of delivering 1.5 mg or more of smoke in the first 3 puffs. Most preferably, embodiments of the invention are capable of delivering 3 mg or more of smoke in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions.

In addition to the aforementioned benefits, preferred cigarettes of the present invention are capable of providing smoke which is chemically simple, consisting essentially of air, oxides of carbon, water, the smoke former, any desired flavors or other desired volatile materials, and trace amounts of other materials. This smoke has no significant mutagenic activity as measured by the Ames Test. In addition, cigarettes of this invention may be made virtually ashless, so that the smoker does not have to remove any ash during use.

The preferred cigarettes of the present invention are described in greater detail in the accompanying drawings and in the detailed description of the invention which follow.

DETAILED DESCRIPTION OF THE PREFERRED EMBODIMENTS

Figure 1:
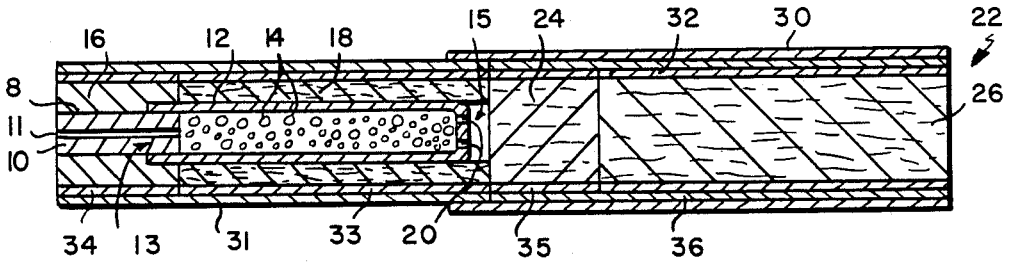
FIGS. 1 and 2 are longitudinal sectional views of different embodiments of the present invention.

The embodiment of the invention illustrated in FIG. 1, has about the same overall dimensions as current cigarettes. It includes a roll or jacket of tobacco 18 which encircles a heat conductive container 12 which encloses a substrate bearing a smoke forming substance. It also comprises a short, combustible carbonaceous fuel element 10, and a mouthend piece shown generally at 22.

Figure 1A:
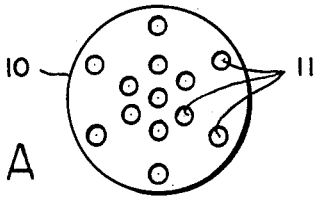
FIGS. 1A, 2B, 2C, and 2D are sectional views of various fuel element passageway configurations useful in the embodiments of the present invention; and FIG. A is an enlarged end view of the metallic capsule used in the cigarette of FIG. 2.

In the embodiment shown in FIG. 1, the extruded carbonaceous fuel element 10 is about 10 mm long and 4.5 mm in diameter and is provided with thirteen passageways 11, as shown in FIG. 1A. FIG. 1A illustrates the currently preferred passageway configuration used in the cigarettes of the present invention.

The fuel element 10 is preferably formed from an extruded mixture of carbon (preferably from carbonized paper), sodium carboxymethylcellulose (SCMC) binder, $K_2CO_3$, and water, as described further below.

The periphery 8 of fuel element 10 is encircled by resilient jacket of insulating fibers 16, such as glass fibers. This jacket tends to reduce radial heat loss and assists in retaining and directing heat from the fuel element toward the smoke generating means and may aid in reducing any fire causing property of the fuel element. Air and hot gases pass through the insulating member and into the tobacco jacket, where they extract tobacco flavors from the tobacco jacket.

The smoke generating means in this embodiment comprises a granular or particulate substrate 14, such as carbon, alumina, and/or densified tobacco, which carry one or more smoke forming substances. This smoke generating means is enclosed within a metallic container 12 having an open fuel end 13 and a closed end 15. As illustrated, the rear of fuel element 10 is inserted into open end 13 of metallic container 12.

The inserted portion of fuel element 10 occupies about 2 to 3 mm of the open end 13 of container 12. End 15 of container 12 is closed, except for a plurality of slots 20 dimensioned to contain the substrate 14, but to permit passage of smoke, air, gases, and/or tobacco flavors therethrough.

At the mouth end of tobacco jacket 18 is a mouthend piece 22, preferably comprising a cylindrical segment of a tobacco paper spacer member 24 and a segment of non-woven thermoplastic fibers 26 through which the smoke passes to the user. The article, or portions thereof, is overwrapped with one or more layers of cigarette papers 30–36.

Figure 2:
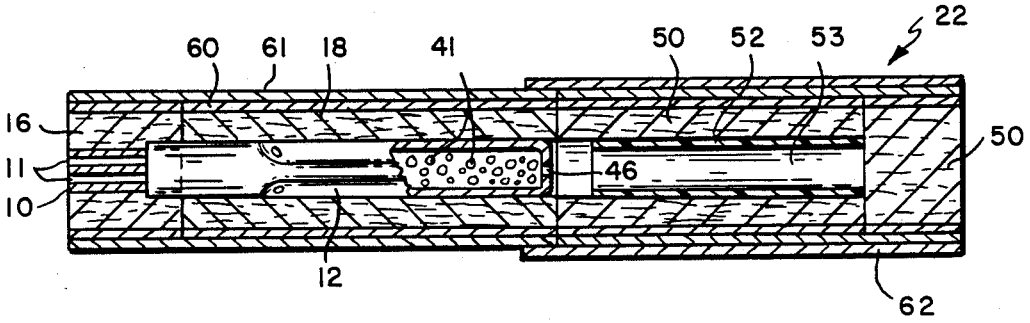
Figure 2A:
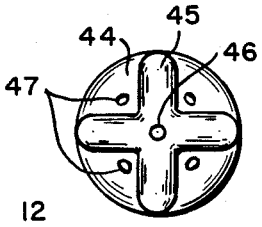

FIG. 2 illustrates another embodiment of the cigarette of the present invention. Overlapping the mouth end of fuel element 10 is metallic capsule 12, about 20 to 35 mm in length, which contains a substrate material 41. The periphery of fuel element 10 in this embodiment is surrounded by a jacket 16 of resilient insulating fibers, such as glass fiber, and capsule 12 is surrounded by a jacket of tobacco 18. The rear portion of capsule 12 is crimped as shown in FIG. 2A to provide an alternating series of grooved channels 44 and ribs 45. As illustrated, a passageway 46 is provided at the mouth end of the capsule in the center of the crimped tube. Four additional passageways 47 are provided at the transition points between the crimped and the uncrimped portion of the capsule. Alternatively, the rear portion of the capsule may have a rectangular cross section in lieu of the channels and ribs, or a tubular capsule may be employed with or without peripheral passageways.

At the mouth end of tobacco jacket 18 is situated a mouthend piece 22 comprised of a cellulose acetate cylinder 50, a centrally located plastic tube 52 which provides smoke passageway 53, and a low efficiency cellulose acetate filter piece 54. As illustrated, the capsule end of plastic tube 52 does not abut the capsule. Thus, vapors flowing through passageways 46 into tobacco jacket 18 flow into passageway 53 where tobacco jacket 18 abuts the cellulose acetate cylinder 50. As illustrated, the cigarette (or portions thereof) is overwrapped with one or more layers of cigarette paper 60, 61 and 62.

In the embodiment shown in FIG. 1, air and gases pass through the fuel element insulating member and into the tobacco jacket. Thus, peripheral passageways in the capsule may not be needed to extract tobacco flavors from the tobacco jacket.

Figure 2B:
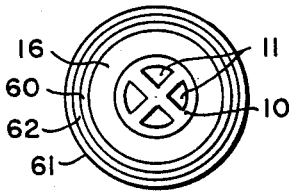
Figure 2C:
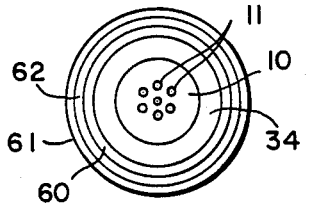
Figure 2D:
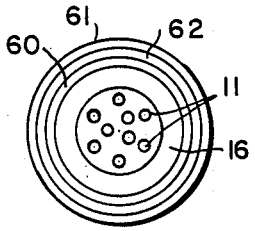

FIG. 2B illustrates one fuel element passageway arrangement useful in the cigarettes of the present invention. As illustrated, an extruded carbonaceous fuel element 10 is employed, with four distinct passageways 11, each having a "wedge shape" or segment arrangement. Another fuel element passageway arrangement is shown at FIG. 2C. As illustrated, fuel element 10 is provided with a plurality of passageways 11, situated near the center of the fuel element so that, during burning, the passageways coalesce into a single passageway, at least at the lighting end of the fuel element. FIG. 2D shows another useful fuel element passageway arrangement in which the element is provided with a plurality of passageways 11.

Upon lighting any of the aforesaid embodiments, the fuel element burns, generating the heat used to volatilize the smoke forming substance or substances in the smoke generating means, and the volatile tobacco flavor material from the tobacco rod. Because the preferred fuel element is relatively short, the hot, burning fire cone is always close to the smoke generating means and the tobacco jacket, which maximizes heat transfer thereto, and resultant production of smoke and flavor. Because of the small size and burning characteristics of the preferred fuel elements employed in the present invention, the fuel element usually begins to burn over substantially all of its exposed length within a few puffs. Thus, that portion of the fuel element adjacent to the smoke generator becomes hot quickly, which significantly increases heat transfer to the smoke generator, especially during the early puffs. Because the preferred fuel element is so short, there is never a long section of nonburning fuel to act as a heat sink.

Heat transferred from the smoke generating means to the peripheral tobacco jacket, whether by conduction or convection, heats the tobacco, thus enabling the heated gases drawn through the the tobacco jacket to more easily extract tobacco flavor components from the jacket. These flavor components mix with the smoke from the smoke generating means, and are delivered to the smoker.

Control of heat transfer to the smoke generating means is important both in terms of transferring enough heat to produce sufficient smoke and in terms of avoiding the transfer of so much heat that the smoke former is degraded. Control of heat transfer is also important to avoid burning of the tobacco jacket which surrounds the smoke generating means. The degree of heat transferred from the fuel element and/or the smoke generating means to the tobacco jacket should be sufficient to permit the release of tobacco flavor components, but should not be so high as to cause pyrolysis or degradation of the tobacco which would contribute undesirable pyrolysis or degradation products to the smoke delivered to the smoker.

Heat transfer is enhanced by the heat conductive material employed in the preferred conductive container for the smoke forming substances, which aids in the distribution of heat to the peripheral tobacco jacket and to the portion of the smoke forming substance which is physically remote from the fuel. This helps produce good smoke and a tobacco flavor in the early puffs.

Preferably, the conductive container is recessed, i.e., spaced from, the lighting end of the fuel element, by at least about 3 mm, preferably by at least about 5 mm or more, to avoid interference with the lighting and burning of the fuel element and to avoid any protrusion after the fuel element is consumed.

The control of heat transfer may also be aided by the use of an insulating member as a peripheral overwrap over at least a part of the fuel element. Such an insulating member helps ensure good smoke production by retaining and directing much of the heat generated by the burning fuel element toward the smoke generating means.

The control of heat transfer from the fuel element to the smoke generating means may also be aided by the presence of a plurality of passageways in the fuel element, which allow the rapid passage of hot gases to the smoke generator, especially during puffing.

Because the smoke forming substance is physically separate from the fuel element, the smoke forming substance is exposed to substantially lower temperatures than are generated by the burning fuel, thereby minimizing the possibility of its thermal degradation. This also results in smoke production almost exclusively during puffing, with little or no smoke production from the smoke generating means during smolder.

In the preferred embodiments of the invention, the short carbonaceous fuel element, the fuel insulating jacket, the recessed heat conducting member, and/or the passages in the fuel cooperate with the smoke generator and the tobacco jacket to provide a system which is capable of producing substantial quantities of tobacco flavored smoke, on virtually every puff. The close proximity of the fire cone to the smoke generator after a few puffs, together with the conductive elements of the container, the conducting member, and/or the fuel insulating jacket, result in high heat delivery both during puffing and during the relatively long period of smolder between puffs.

While not wishing to be bound by theory, it is believed that the smoke generating means is maintained at a relatively high temperature between puffs, and that the additional heat delivered during puffs, which is significantly increased by the preferred passageways in the fuel element, is primarily utilized to vaporize the smoke forming substance. This increased heat transfer makes more efficient use of the available fuel energy, reduces the amount of fuel needed, and helps deliver early smoke. Furthermore, the conductive heat transfer utilized in the present invention is believed to reduce the carbon fuel combustion temperature which, it is further believed, reduces the $CO/CO_2$ ratio in the combustion products produced by the fuel. See, e.g., G. Hagg, *General Inorganic Chemistry,* at p. 592 (John Wiley & Sons, 1969).

As used herein, and only for the purposes of this application, "smoke" is defined to include vapors, gases, particles, and the like, both visible and invisible, and especially those components perceived by the smoker to be "smoke-like", especially those which are generated by action of the heat from the burning fuel element upon substances contained within the smoke generating means, the tobacco jacket or elsewhere in the cigarette.

As used herein, a "cigarette" comprises a roll or cylindrical mass of tobacco wrapped in a paper wrapping. Preferred cigarettes of the present invention also comprise a short, preferably carbonaceous fuel element, and a physically separate smoke generating means, containing an smoke forming material.

As used herein, the term "carbonaceous" means primarily comprising carbon.

As used herein, the term "insulating member" applies to all materials which act primarily as insulators. Preferably, these materials do not burn during use, but they may include slow burning carbons and like materials, as well as materials which fuse during use, such as low temperature grades of glass fibers. The insulators have a thermal conductivity in g-cal/(sec) ($cm^2$)(°C./cm), of less than about 0.05, preferably less than about 0.02, most preferably less than about 0.005, see, *Hackh's Chemical Dictionary* 34 (4th ed., 1969) and Lange's *Handbook of Chemistry* 10, 272–274 (11th ed., 1973).

In general, the combustible fuel elements which may be employed in practicing the invention have a diameter no larger than that of other cigarettes (i.e., less than or equal to 8 mm), and are generally less than about 30 mm long. Advantageously the fuel element is about 20 mm or less in length, preferably about 15 mm or less in length. Advantageously, the diameter of the fuel element is between about 3 to 7 mm, preferably about 4 to 5 mm. The density of the fuel elements employed herein may range from about 0.5 g/cc to about 1.5 g/cc as measured, e.g., by mercury displacement. Preferably the density is greater than about 0.7 g/cc, more preferably greater than about 0.8 g/cc.

The preferred fuel elements employed herein are primarily formed of a carbonaceous material. Carbonaceous fuel elements are preferably from about 5 to 15 mm, more preferably, from about 8 to 12 mm in length. Preferably, the density is greater than 0.7 g/cc. Carbonaceous fuel elements having these characteristics are sufficient to provide fuel for at least about 7 to 10 puffs, the normal number of puffs generally obtained by smoking a cigarette under FTC conditions.

Preferably, the carbon content of these fuel elements is at least 60 to 70%, most preferably about 80% or more, by weight High carbon content fuel elements are preferred because they produce minimal pyrolysis and incomplete combustion products, little or no visible sidestream smoke, and minimal ash, and have high heat capacity. However, lower carbon content fuel elements e.g., about 50 to 60% carbon by weight, are within the scope of this invention.

The carbonaceous materials used in or as the preferred fuel element may be derived from virtually any of the numerous carbon sources known to those skilled in the art. Preferably, the carbonaceous material is obtained by the pyrolysis or carbonization of cellulosic materials, such as wood, cotton, paper, and the like, although carbonaceous materials from other sources may be used.

In most instances, the carbonaceous fuel elements should be capable of being ignited by a cigarette lighter without the use of an oxidizing agent. Burning characteristics of this type may generally be obtained from a cellulosic material which has been pyrolyzed at temperatures between about 400° C. to about 1000° C., preferably between about 500° C. to about 950° C., most preferably at about 750° C., in an inert atmosphere or under a vacuum. The pyrolysis time is not believed to be critical, as long as the temperature at the center of the pyrolyzed mass has reached the aforesaid temperature range for at least a few, e.g., about 15, minutes. A slow pyrolysis, employing gradually increasing temperatures over many hours, is believed to produce a uniform material with a high carbon yield. The pyrolyzed material is then cooled, ground to a fine powder, and optionally heated in an inert gas stream at a temperature between about 650° C. to 750° C. to remove volatiles prior to further processing.

While undesirable in most cases, carbonaceous materials which require the use of an oxidizing agent to render them ignitable by a cigarette lighter are within the scope of this invention, as are carbonaceous materials which require the use of a glow retardant or other type of combustion modifying agent. Such combustion modifying agents are disclosed in many patents and publications and are well known to those of ordinary skill in the art.

In certain preferred embodiments, the carbonaceous fuel elements are substantially free of volatile organic material. By that, it is meant that the fuel element is not purposely impregnated or mixed with substantial amounts of volatile organic materials, such as volatile smoke forming or flavoring agents, which could degrade in the burning fuel. However, small amounts of materials, e.g., water, which are naturally adsorbed by the carbon in the fuel element, may be present therein. Similarly, small amounts of smoke forming substances may migrate from the smoke generating means and thus may also be present in the fuel.

A preferred carbonaceous fuel element is a pressed or extruded mass of carbon prepared from a powdered carbon and a binder, by known pressure forming or extrusion techniques. A preferred carbon for such a fuel element is prepared from pyrolyzed papers such as Grande Prairie Canadian Kraft, available from the Buckeye Cellulose Corporation of Memphis, Tenn.

The binders which may be used in preparing such a fuel element are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, and other cellulose derivatives, such as methylcellulose and carboxymethylcellulose (CMC).

A wide range of binder concentrations can be utilized. Preferably, the amount of binder is limited to minimize contribution of the binder to undesirable combustion products. On the other hand, sufficient binder must be included to hold the fuel element together during manufacture and use. The amount used will thus depend on the cohesiveness of the carbon in the fuel.

In general, an extruded carbonaceous fuel may be prepared by admixing from about 50 to 99 weight percent, preferably about 80 to 95 weight percent, of the carbonaceous material, with from 1 to 50 weight percent, preferably about 5 to 20 weight percent of the binder, with sufficient water to make a paste having a stiff dough-like consistency. The dough is then extruded using a standard ram or piston type extruder into the desired shape, with the desired number and configuration of passageways, and dried to reduce the moisture content. Alternatively, or additionally, the passageways and/or cavity may be formed using standard drilling techniques.

If desired, carbon/binder fuel elements may be pyrolyzed after formation, for example, to about 650° C. or higher for two hours, to convert the binder to carbon and thereby form a virtually 100% carbon fuel element.

The fuel elements of the present invention also may contain one or more additives to improve burning, such as up to about 5 weight percent of sodium chloride to improve smoldering characteristics and as a glow retardant. Also, up to about 5, preferably from about 1 to 2, weight percent of potassium carbonate may be included to control flammability. Additives to improve physical characteristics, such as clays like kaolins, serpentines, attapulgites and the like also may be used.

Preferably, the carbonaceous fuel element is provided with one or more longitudinally extending passageways. These passageways help to control transfer of heat from the fuel element to the smoke generating means, which is important both in terms of transferring enough heat to produce sufficient smoke and in terms of avoiding the transfer of so much heat that the smoke former is degraded. Generally, these passageways provide porosity and increase early heat transfer to the substrate by increasing the amount of hot gases which reach the substrate. They also tend to increase the rate of burning.

Generally, a large number of passageways, e.g., about 5 to 13 or more, especially with relatively wide spacings between the passageways produce high convective heat transfer, which leads to high smoke delivery. A large number of passageways also generally helps assure ease of lighting.

High convective heat transfer tends to produce a higher CO output in the mainstream. To reduce CO levels, fewer passageways or a higher density fuel element may be employed, but such changes generally tend to make the fuel element more difficult to ignite, and to decrease the convective heat transfer, thereby lowering the smoke delivery rate and amount. However, it has been discovered that with passageway arrangements which are closely spaced, as the inner passageways in FIG. 1A, such that they burn out or coalesce to form one passageway, at least at the lighting end, the amount of CO in the combustion products is generally lower than in the same, but widely spaced, passageway arrangement.

The smoke generating means used in practicing this invention is physically separate from the fuel element. By physically separate it is meant that the substrate, container, or chamber which contains the smoke forming materials is not mixed with, or a part of, the fuel element. This arrangement helps reduce or eliminate thermal degradation of the smoke forming substance and the presence of sidestream smoke. While not a part of the fuel element, the smoke generating means preferably abuts, is connected to, or is otherwise adjacent to the fuel element so that the fuel and the smoke generating means are in a conductive heat exchange relationship. Preferably, the conductive heat exchange relationship is achieved by providing a heat conductive member, such as a metal foil, recessed from the lighting end of the fuel element, which efficiently conducts or transfers heat from the burning fuel element to the smoke generating means.

The smoke generating means is preferably spaced no more than 15 to 20 mm from the lighting end of the fuel element. The smoke generating means may vary in length from about 2 mm to about 60 mm, preferably from about 5 mm to 40 mm, and most preferably from about 20 mm to 35 mm. The diameter of the smoke generating means may vary from about 2 mm to about 8 mm, preferably from about 3 to 6 mm.

Preferably, the smoke generating means includes one or more thermally stable materials which carry one or more smoke forming substances. As used herein, a "thermally stable" material is one capable of withstanding the high, albeit controlled, temperatures, e.g., from about 400° C. to about 600° C., which may eventually exist near the fuel, without significant decomposition or burning.

Thermally stable materials which may be used as the carrier or substrate for the smoke forming substance are well known to those skilled in the art. Useful carriers should be porous, and must be capable of retaining a smoke forming compound and releasing a potential smoke forming vapor upon heating by the fuel. Useful thermally stable materials include adsorbent carbons, such as porous grade carbons, graphite, activated, or non-activated carbons, and the like, such as PC-25 and PG-60 available from Union Carbide Corp., Danbury, Conn., as well as SGL carbon, available from Calgon. Other suitable materials include inorganic solids, such as ceramics, glass, alumina, vermiculite, clays such as bentonite, and the like. Carbon and alumina substrates are preferred.

An especially useful alumina substrate is available from the Davison Chemical Division of W. R. Grace & Co. under the designation SMR-14-1896. Before use, this alumina is sintered at elevated temperatures, e.g., greater than 1000° C., washed, and dried.

The smoke forming substance or substances used in the cigarettes of the present invention must be capable of forming smoke at the temperatures present in the smoke generating means upon heating by the burning fuel element. Such substances preferably will be composed of carbon, hydrogen and oxygen, but they may include other materials. Such substances can be in solid, semisolid, or liquid form. The boiling or sublimation point of the substance and/or the mixture of substances can range up to about 500° C.

Preferred smoke forming substances are selected from glycerin, triethylene glycol and propylene glycol, and mixtures thereof.

When a substrate material is employed as a carrier, the smoke forming substance may be dispersed on or within the substrate in a concentration sufficient to permeate or coat the material, by any known technique. For example, the smoke forming substance may be applied full strength or in a dilute solution by dipping, spraying, vapor deposition, or similar techniques. Solid smoke forming components may be admixed with the substrate material and distributed evenly throughout prior to formation of the final substrate.

While the loading of the smoke forming substance will vary from carrier to carrier and from smoke forming substance to smoke forming substance, the amount of liquid smoke forming substances may generally vary from about 20 mg to about 120 mg, preferably from about 35 mg to about 85 mg, and most preferably from about 45 mg to about 65 mg. As much as possible of the smoke former carried on the substrate should be delivered to the smoker as WTPM. Preferably, above about 2 weight percent, more preferably above about 15 weight percent, and most preferably above about 20 weight percent of the smoke former carried on the substrate is delivered to the smoker as WTPM.

The smoke generating means also may include one or more volatile flavoring agents, such as menthol, vanillin, tobacco extracts, and other agents which impart flavor to the smoke. It also may include any other desirable volatile solid or liquid materials. Alternatively, these optional agents may be placed between the smoke generating means and the mouth end, such as in a separate substrate or chamber or coated within the passageway leading to the mouth end, in the tobacco jacket, or in any other tobacco charges.

One particularly preferred smoke generating means comprises the aforesaid alumina substrate containing spray dried tobacco extract, tobacco flavor modifiers, such as levulinic acid, one or more flavoring materials, and a smoke forming material, such as glycerin.

As shown in the illustrated embodiments, the smoke generating means, or at least a portion thereof, is circumscribed by a tobacco rod through which gases and vapors, and optionally the smoke forming material, pass during smoking of the cigarette. During smoking, hot vapors are swept through the tobacco to extract and distill the volatile components from the tobacco, without combustion or substantial pyrolysis. Thus, the smoker receives smoke which contains the tastes and flavors of natural tobacco without the numerous combustion products produced by cigarettes which burn tobacco.

The tobacco containing material employed around the smoke generating means may contain any tobacco available to the skilled artisan, such as Burley, Flue Cured, Turkish, reconstituted tobacco, extruded tobacco mixtures, tobacco containing sheets, and the like. Advantageously, a blend of tobaccos may be used to contribute a greater variety of flavors. The tobacco containing material may also include known tobacco additives, such as fillers, casings, reinforcing agents, humectants, and the like. Flavor agents may likewise be added to the tobacco jacket, as well as flavor modifying agents.

Preferred embodiments of the invention normally do not employ tobacco around the fuel element in order to avoid the production of tobacco pyrolysis and degradation products and their incorporation into the smoke delivered to the smoker. However, tobacco may be employed around the fuel element to provide the smoker with both the aroma of burning tobacco during use, as well as tobacco flavor in the mainstream smoke. In embodiments of that type, the tobacco is preferably consumed only to the extent that the fuel element is consumed, i.e., up to about the point of contact between the fuel element and the smoke generating means. This may be achieved by compressing the tobacco around the fuel element and employing a heat conducting member between the tobacco jacket and the rear portion of the fuel element and/or the smoke forming material. It also may be achieved by treating the cigarette paper overwrap and/or the tobacco with materials which help extinguish the tobacco at the point were it overlaps the smoke generating means.

The heat conducting material preferably employed in constructing the preferred container for the smoke generating means and/or the heat conducting member is typically a metallic tube, strip, or foil, such as aluminum, varying in thickness from less than about 0.01 mm to about 0.2 mm, or more. The thickness and/or the type of conducting material may be varied (e.g., other metals or Grafoil, from Union Carbide) to achieve virtually any desired degree of heat transfer. As shown in the illustrated embodiments, the heat conducting material preferably contacts or overlaps the rear portion of the fuel element, and forms the container which encloses the smoke forming substance. However, more than one member or material may be employed to perform these functions.

Preferably, the heat conducting member extends over no more than about one-half the length of the fuel element. More preferably, the heat conducting member overlaps or otherwise contacts no more than about the rear 5 mm of the fuel element. Preferred recessed members of this type do not interfere with the lighting or burning characteristics of the fuel element. Such members help to extinguish the cigarette when the fuel element has been consumed to the point of contact with the conducting member, by acting as a heat sink. These members also do not protrude from the lighting end of the cigarette even after the fuel element has been consumed.

The heat conductive container may be provided with additional passages adjacent the tobacco jacket which direct additional gases and vapors to flow through the bed of tobacco. These passages also may be used to help control the pressure drop through the cigarette. As illustrated in FIG. 2, the heat conductive container also may be crimped or shaped to help control the pressure drop, or to provide other desirable effects.

The fuel element insulating members employed in practicing the invention are preferably formed into a resilient jacket from one or more layers of an insulating material. Advantageously, this jacket is at least about 0.5 mm thick, preferably at least about 1 mm thick, more preferably between about 1.5 to 2 mm thick. Preferably, the jacket extends over more than about half, if not all of the length of the fuel element.

Insulating members which may be used in accordance with the present invention generally comprise inorganic or organic fibers such as those made out of glass, alumina, silica, vitreous materials, mineral wool, carbons, silicons, boron, organic polymers, and the like, including mixtures of these materials. Nonfibrous insulating materials, such as silica aerogel, pearlite, glass, and the like may also be used. Preferred insulating members are resilient, and feel like a cigarette. These materials act primarily as an insulating jacket, retaining and directing a significant portion of the heat formed by the burning fuel element to the smoke generating means, while permitting heated air and gases to pass through the tobacco rod. Because the insulating jacket becomes hot adjacent to the burning fuel element, to a limited extent, it also may conduct heat toward the smoke generating means.

The currently preferred insulating fibers are ceramic fibers, such as glass fibers. The preferred glass fibers include experimental materials produced by Owens-Corning of Toledo, Ohio under the designations 6432, 6437 and C-glass, also produced by Owens-Corning.

Several commercially available inorganic insulating fibers are prepared with a binder e.g., PVA, which acts to maintain structural integrity during handling. These binders, which would exhibit a harsh aroma upon heating, should be removed, e.g., by heating in air at about 650° C. for up to about 15 min. before use herein. If desired, pectin, at up to about 3 wt. percent may be added to the fibers to provide mechanical strength to the jacket without contributing harsh aromas.

In most embodiments of the invention, the fuel and smoke generating means will be attached to a mouthend piece, although a mouthend piece may be provided separately, e.g., in the form of a cigarette holder. This element of the cigarette provides the enclosure which channels the vaporized smoke forming substance into the mouth of the smoker. Due to its length, about 35 to 50 mm, it also keeps the hot fire cone away from the mouth and fingers of the smoker, and provides sufficient time for the hot smoke to cool before reaching the smoker.

Suitable mouthend pieces should be inert with respect to the smoke forming substances, should offer minimum smoke loss by condensation or filtration, and should be capable of withstanding the temperature at the interface with the other elements of the cigarette. Preferred mouthend pieces include those described in connection with FIGS. 1 and 2. Other suitable mouthpieces will be apparent to those of ordinary skill in the art.

The entire length of the cigarette, or any portion thereof, will be overwrapped with one or more layers of cigarette paper. Preferred papers at the fuel element end should not openly flame during burning of the fuel element. In addition, the paper should have controllable smolder properties and should produce a grey ash.

In those embodiments utilizing an insulating jacket wherein the paper burns away from the jacketed fuel element, maximum heat transfer is achieved because air flow to the fuel element is not restricted. However, papers can be designed or engineered to remain wholly or partially intact upon exposure to heat from the burning fuel element. Such papers provide the opportunity to restrict air flow to the burning fuel element, thereby controlling the temperature at which the fuel element burns and the subsequent heat transfer to the smoke generating means.

To reduce the burning rate and temperature of the fuel element, thereby maintaining a low $CO/CO_2$ ratio, a non-porous or zero-porosity paper treated to be slightly porous, e.g., non-combustible mica paper with a plurality of holes therein, may be employed as the overwrap layer. Such a paper controls heat delivery, especially in the middle puffs (i.e., 4–6).

To maximize smoke delivery, which otherwise would be diluted by radial (i.e., outside) air infiltration through the cigarette, a non-porous paper may be used from the smoke generating means to the mouth end.

Papers such as these are known in the cigarette and/or paper arts and mixtures of such papers may be employed for various functional effects. Preferred papers used in the cigarettes of the present invention include ECUSTA 01788 and 646 plug wrap manufactured by Ecusta of Pisgah Forest, NC, and Kimberly-Clark's KC-63-5, P 878-5, P 878-16-2, and 780-63-5 papers, as well as the papers identified in the examples.

The smoke produced by the preferred cigarettes of the present invention is chemically simple, consisting essentially of air, water, oxides of carbon, the smoke former, any desired flavors or other desired volatile materials, and trace amounts of other materials. The WTPM produced by the preferred cigarettes of this invention has no measurable mutagenic activity as measured by the Ames test, i.e., there is no significant dose response relationship between the WTPM produced by preferred cigarettes of the present invention and the number of revertants occurring in standard test microorganisms exposed to such products. According to the proponents of the Ames test, a significant dose dependent response indicates the presence of mutagenic materials in the products tested. See Ames et al., *Mut. Res.*, 31:347-364 (1975); Nagao et al., *Mut. Res.*, 42:335 (1977).

A further benefit from the preferred embodiments of the present invention is the relative lack of ash produced during use in comparison to ash from current cigarettes. As the preferred carbon fuel element is burned, it is essentially converted to oxides of carbon, with relatively little ash generation, and thus there is no need to dispose of ashes while using the cigarette.

The cigarettes of the present invention will be further illustrated with reference to the following examples, which aid in the understanding of the present invention, but which are not to be construed as limitations thereof. All percentages reported herein, unless otherwise specified, are percent by weight. All temperatures are expressed in degrees Celsius. In all instances, the cigarettes have a diameter of about 7 to 8 mm, the diameter of a cigarette.

EXAMPLE 1

A cigarette of the type illustrated in FIG. 1 was assembled by insertion of a fuel element/smoke generator capsule into a tubular rod of cut tobacco filler, and attaching the rod to a mouthend piece, in the following manner:

A. Tobacco Rod Preparation

A 7.5 mm diameter tobacco rod of puffed tobacco (28 mm long) with an overwrap of Kimberly-Clark's P1487-125 cigarette paper was modified by insertion of a probe to have a longitudinal passageway of about 4.5 mm diameter therein.

B. Fuel Source Preparation

The fuel element (10 mm long, 4.5 mm o.d.) having an apparent (bulk) density of about 0.86 g/cc, was prepared from carbon (90 wt. percent), SCMC binder (10 wt. percent) and $K_2CO_3$ 1 wt. percent).

The carbon was prepared by carbonizing a non-talc containing grade of Grand Prairie Canadian Kraft hardwood paper under a nitrogen blanket, at a step-wise increasing temperature rate of about 10 ° C. per hour to a final carbonizing temperature of 750° C..

After cooling under nitrogen to less than about 35° C., the carbon was ground to a mesh size of minus 200. The powdered carbon was then heated to a temperature of up to about 850° C. to remove volatiles.

After again cooling under nitrogen to less than about 35° C., the carbon was ground to a fine powder, i.e., a powder having an average particle size of from about 0.1 to 50 microns.

This fine powder was admixed with Hercules 7HF SCMC binder (9 parts carbon 1 part binder), 1 wt. percent $K_2CO_3$, and sufficient water to make a stiff, dough-like paste.

Fuel elements were extruded from this paste having seven central holes each about 0.021 in. in diameter and six peripheral holes each about 0.01 in. in diameter. The web thickness or spacing between the central holes was about 0.008 in. and the average outer web thickness (the spacing between the periphery and peripheral holes) was 0.019 in. as shown in FIG. 1A.

These fuel elements were then baked-out under a nitrogen atmosphere at 900° C. for three hours after formation.

C. Spray Dried Extract

A blend of flue cured tobaccos was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a standard spray dryer, such as an Anhydro Size No. 1, at an inlet temperature of from about 215°-230° C. and collecting the dried powder material at the outlet of the drier. The outlet temperature varied from about 82°-90° C.

D. Preparation of Sintered Alumina

High surface area alumina (surface area of about 280 $m^2/g$) from Alcoa, having a mesh size of from −14 to +20 (U.S.) was sintered at a soak temperature of about 1400° C. to 1550° C. for about one hour, washed with water and dried. This sintered alumina was combined, in a two step process, with the ingredients shown in Table I in the indicated proportions:

TABLE I

| | |
|---|---|
| Alumina | 69.44% |
| Glycerin | 16.90% |
| Spray Dried Extract | 7.56% |
| Flavor Package | 6.58% |

The flavor package is a mixture of flavor compounds (e.g., oriental tobacco, Firmenich Flavor #155, Firmenich Flavor PTGA No. 0208, and Firmenich Flavor #850.030) which simulates the taste of cigarette smoke.

In the first step, the spray dried tobacco extract was mixed with sufficient water to form a slurry. This slurry was then applied to the alumina carrier described above by mixing until the slurry was uniformly absorbed by the alumina. The treated alumina was then dried to reduce the moisture content to about 1 wt. percent. In the second step, this treated alumina was mixed with a combination of the other listed ingredients (10% in propylene glycol) until the liquid was substantially absorbed within the alumina carrier.

D. Assembly

The capsule used to construct the FIG. 1 cigarette was prepared from deep drawn aluminum. The capsule had an average wall thickness of about 0.004 in. (0.01 mm), and was about 30 mm in length, having an outer diameter of about 4.5 mm. The rear of the container was sealed with the exception of two slot-like openings (each about 0.65×3.45 mm, spaced about 1.14 mm apart) to allow passage of the smoke former to the smoker. About 325 mg of the smoke producing substrate described above was used to load the capsule. A fuel element prepared as above, was inserted into the open end of the filled capsule to a depth of about 3 mm.

F. Insulating Jacket

The fuel element capsule combination was overwrapped at the fuel element end with a 10 mm long, glass fiber jacket of Owens-Corning 6437 (having a softening point of about 650° C.), with 3 wt. percent pectin binder, to a diameter of about 7.5 mm. The glass fiber jacket was then wrapped with an innerwrap material, a Kimberly-Clark paper designated 63-5.

G. Assembly

The jacketed fuel element-capsule combination was inserted into the tobacco rod passageway until the glass fiber jacket abutted the tobacco. The glass fiber and tobacco sections were joined together by an outerwrap material which circumscribed both the fuel element/insulating jacket/innerwrap combination and the wrapped tobacco rod. The outerwrap was a Kimberly-Clark paper designated P1768-65-2 treated with RJR Experimental Flavor #28 and 5.2% potassium succinate.

H. Mouthend Piece

A mouthend piece of the type illustrated in FIG. 1 was constructed by combining two sections: (1) a 10 mm long, 7.5 mm diameter spacer member adjacent the capsule, prepared from a gathered tobacco sheet material, treated with $K_2CO_3$, flavor and spray dried extract, and obtained from Kimberly-Clark Corporation under the designation P144-185-GAPF, overwrapped with Kimberly Clark's P850-186-2 paper and (2) a 30 mm long, 7.5 mm diameter cylindrical segment of a gathered non-woven meltblown thermoplastic polypropylene web, treated with RJR Experimental Flavor #118-5, and obtained from Kimberly-Clark Corporation under the designation P-1483-90-4, overwrapped with Kimberly-Clark Corporation's P1487-125 paper. These two sections were combined with a combining overwrap of Kimberly-Clark Corporation's P850-186-2 paper.

I. Final Assembly

The combined mouthend piece section was joined to the tobacco-fuel element-capsule section by a final overwrap of Ecusta's 30637-801-12001 tipping paper.

Cigarettes thus prepared produced a smoke resembling tobacco smoke without any undesirable off-taste due to scorching or thermal decomposition of the smoke forming material.

EXAMPLE 2

Several cigarettes of the present invention were prepared as described in Example 1, and smoked under FTC smoking conditions. The collected WTPM from these cigarettes was then tested in the Ames assay as described below with no evidence of mutagenicity.

Fifteen cigarettes of the type described in Example 1 under FTC conditions afforded the following:

| Cigarette No. | P.D. | Bypass | No. Puffs |
|---|---|---|---|
| 1 | 94 | 28 | 8 |
| 2 | 101 | 22 | 7 |
| 3 | 109 | 20 | 7 |
| 4 | 103 | 18 | 8 |
| 5 | 109 | 21 | 8 |
| 6 | 110 | 22 | 9 |
| 7 | 109 | 26 | 9 |
| 8 | 102 | 18 | 9 |
| 9 | 112 | 21 | 9 |
| 10 | 108 | 29 | 9 |
| 11 | 88 | 28 | 8 |
| 12 | 113 | 24 | 8 |
| 13 | 100 | 29 | 8 |
| 14 | 113 | 19 | 8 |
| 15 | 108 | 22 | 8 |
| Total | 105.3 | 23.1 | 8.2 |
| Average | | | |

The total WTPM delivery for the fifteen cigarettes was 147.4 mg or an average of 9.8 mg per cigarette.

Delivery data for these cigarettes when smoked under FTC conditions afforded the following:

| No. Reps. | WTPM mg | Nicotine μg | Glycerine mg | Water mg | CO mg | $CO_2$ mg |
|---|---|---|---|---|---|---|
| Avg. 222 | 10.4 | 292 | 3.85 | 4.09 | 11.3 | 32.6 |
| S.D. | 1.24 | 36 | 0.53 | 0.61 | 0.90 | 1.90 |

The Cambridge pads containing the 147.4 mg of collected WTPM form the fifteen cigarettes smoked above were shaken for 30 minutes in DMSO to dissolve the WTPM. Each sample was then diluted to a concentration of 1 mg/ml and used "as is" in the Ames assay.

Using the procedure of Nagao et al., *Mut. Res.* 42: 335-342 (1977), 1 mg/ml concentrations of WTPM were admixed with the S-9 activating system, plus the standard Ames bacterial cells, and incubated at 37° C. for twenty minutes. The bacterial strains used in this Ames assay were *Salmonella typhimurium,* TA 98 and TA 100. See Purchase et al., *Nature,* 264:624-627 (1976). Agar was then added to the mixture, and plates were prepared The agar plates were incubated for two days at 37° C., and the resulting cultures were counted.

Three plates were run for each dilution and the results of the colonies were compared against a pure DMSO control culture. As shown below, there was no mutagenic activity caused by the WTPM obtained from any of the cigarettes tested, as the number of revertants varies little from the control value. For mutagenic samples, the mean number of revertants per plate will increase significantly with increasing doses.

| | Dose (μg WTPM/Plate) | Mean Revertants/Plate TA 98 |
|---|---|---|
| Control | 0 | 25.7 ± 9.7 |
| | 250 | 31.0 ± 12.7 |
| | 500 | 25.0 ± 2.0 |
| | 700 | 28.7 ± 6.4 |
| | 950 | 25.7 ± 2.1 |
| | 1200 | 34.4 ± 11.4 |
| | 1400 | 32.0 ± 13.2 |
| | **Dose (μg WTPM/Plate)** | **Mean Revertants/Plate TA 100** |
| Control | 0 | 102.0 ± 3.0 |
| | 250 | 107.3 ± 20.0 |
| | 500 | 81.0 ± 2.6 |
| | 700 | 105.7 ± 16.1 |
| | 950 | 129.3 ± 3.1 |
| | 1200 | 99.7 ± 6.0 |
| | 1400 | 87.7 ± 7.6 |

EXAMPLE 3

A cigarette of the type illustrated in FIG. 1 was made in the following manner.

A. Tobacco Rod Preparation

A 24.1 mm circumference tobacco rod with an overwrap of Kimberly-Clark's P1487-125 paper was manufactured on a Protos cigarette maker (Hauni).

B. Fuel Source Preparation

The fuel element (10 mm long, 4.5 mm o.d.) having an apparent (bulk) density of about 0.93 g/cc, was prepared from carbon (89 wt. percent), SCMC binder (10 wt. percent) and $K_2CO_3$ (1 wt. percent).

The carbon was prepared by carbonizing a non-talc containing grade of Grand Prairie Canadian Kraft hardwood paper under a nitrogen blanket to a final carbonizing temperature of 750° C.

After cooling under nitrogen to less than about 35° C., the carbon was ground to a mesh size of about 200. The powdered carbon was then heated to a temperature of up to about 850° C. to remove volatiles.

After again cooling under nitrogen to less than about 35° C., the carbon was ground to a fine powder, i.e., a powder having an average particle size of from about 0.1 to 50 microns.

This fine powder was admixed with Hercules 7HF SCMC binder (9 parts carbon:1 part binder), 1 wt. percent $K_2CO_3$, and sufficient water to make a stiff, dough-like paste.

fuel elements were extruded from this paste having seven central holes each about 0.021 in. in diameter and six peripheral holes each about 0.01 in. in diameter. The web thickness or spacing between the central holes was 0.008 in. and the average outer web thickness (the spacing between the periphery and peripheral holes) was 0.019 in. as shown in FIG. 4A.

These fuel elements were then baked-out under a nitrogen atmosphere at 1000° C. for three hours after formation.

C. Spray Dried Extract

A blend of flue cured tobaccos was ground to a medium dust and extracted with water in a stainless steel tank at a concentration of from about 1 to 2% tobacco in water. The extraction was conducted at ambient temperature using mechanical agitation for from about 5 to 15 minutes. The admixture was centrifuged to remove suspended solids and the aqueous solution to a conventional spray dryer, such as Anhydro Size No. 3, at an inlet temperature of from about 180°-200° C. and collecting the dried powder material at the outlet of the drier. The outlet temperature varied from about 80°-85° C.

D. Preparation of Sintered Alumina

High surface area alumina (surface area of about 280 $m^2/g$) from Alcoa, having a mesh size of from −14 to +20 (U.S.) was sintered at a soak temperature of about 1400° C. to 1500° C. for about one hour, washed with water and dried. This sintered alumina was combined, in a two step process, with the ingredients shown in Table I in the indicated proportions:

TABLE 1

| | |
|---|---|
| Alumina | 67.6 |
| Glycerin | 21.8 |
| Spray Dried Extract | 7.7 |
| Flavor Package | 0.1 |
| Fructose | 2.8 |
| TOTAL: | 100.0% |

The flavor package is an experimental mixture of flavor compounds which simulates the taste of cigarette smoke.

In the first step, the spray dried tobacco extract and fructose were mixed with sufficient water to form a slurry. This slurry was then applied to the alumina carrier described above by mixing until the slurry was uniformly absorbed by the alumina. The treated alumina was then dried to reduce the moisture content to about 1 wt. percent. In the second step, this treated alumina was mixed with a combination of the other listed ingredients until the liquid was substantially absorbed within the alumina carrier.

D. Assembly

The capsule used to construct the FIG. 1 cigarette was prepared from deep drawn aluminum. The capsule had an average wall thickness of about 0.004 in. (0.01 mm), and was about 30 mm in length, having an outer diameter of about 4.5 mm. The rear of the container was sealed with the exception of two slot-like openings (each about 0.65×3.45 mm, spaced about 1.14 mm apart) to allow passage of the aerosol former to the user. About 337 mg of the aerosol producing substrate described above was used to load the capsule. A fuel element prepared as above, was inserted into the open end of the filled capsule to a depth of about 3 mm.

F. Insulating Jacket

A mat of glass fiber of Owens-Corning glass (having a softening point of about 750° C.), with 3 wt. percent pectin binder, was formed around a straw and wrapped with Kimberly-Clark paper designated P780-63-5. The glass fiber jackets had a circumference of 24.1 mm and were cut to a final length of 10 mm.

G. Assembly

The glass fiber and tobacco sections were joined together by an outerwrap material which circumscribed both the insulating jacket/innerwrap combination and the wrapped tobacco rod. The outerwrap was a Kimberly-Clark paper designated P1768-65-2. The fuel element-capsule combination was inserted into the combined glass fiber and tobacco sections.

H. Mouthend Piece

A mouthend piece of the type illustrated in FIG. 1 was constructed by combining two sections: (1) a 10 mm long, 7.5 mm diameter spacer member adjacent the capsule, prepared from gathered tobacco sheet material obtained from Kimberly-Clark Corporation designated P144-B, overwrapped with Kimberly-Clark's P1487-184-2 paper and (2) a 30 mm long, 7.5 mm diameter cylindrical segment of gathered non-woven meltblown thermoplastic polypropylene web obtained from Kimberly-Clark Corporation designated PP-100 overwrapped with Kimberly-Clark Corporation's P1487-184-2 paper. These two sections were combined with a combining overwrap of Kimberly-Clark Corporation's P850-186-2 paper.

I. Assembly

The combined mouthend piece section was joined to the tobacco-fuel element-capsule section by a final overwrap of Ecusta's 30637-801-12001 tipping paper.

Cigarettes thus prepared produced a smoke without any undesirable off-taste due to scorching or thermal decomposition of the smoke forming material.

What is claimed is:

1. A cigarette comprising:

(a) a rod of tobacco having a longitudinal passage therein;

(b) a heat conductive container located in the passage in the tobacco rod, containing a smoke forming material;

(c) a carbonaceous fuel element less than 30 mm in length and 7 mm in diameter prior to smoking, having a plurality of longitudinal passages, the fuel element being located at one end of the heat conductive container;

(d) a resilient insulating member at least 0.5 mm thick circumscribing the periphery of the fuel element; and (e) a mouthend piece attached to the tobacco rod for delivering smoke and tobacco flavor from the tobacco rod and the heat conductive container to the smoker.

2. The cigarette of claim 1, wherein the rod of tobacco comprises cut filler.

3. The cigarette of claim 1, wherein the heat conductive container further contains a source of tobacco flavor.

4. The cigarette of claim 1, wherein the carbonaceous fuel element contacts the heat conductive container.

5. The cigarette of claim 1, wherein the carbonaceous fuel element is less than about 15 mm in length, and between about 4 and 5 mm in diameter.

6. The cigarette of claim wherein the resilient insulating member comprises glass fibers.

7. The cigarette of claim wherein the resilient insulating member comprises tobacco.

* * * * *